United States Patent [19]

Musgrave

[11] 4,452,002

[45] Jun. 5, 1984

[54] MAGAZINE FILLING GUIDE

[76] Inventor: Daniel D. Musgrave, 8201 Caraway St., Cabin John, Md. 20818

[21] Appl. No.: 399,684

[22] Filed: Jul. 19, 1982

[51] Int. Cl.[3] ..... F42B 39/06

[52] U.S. Cl. ..... 42/87

[58] Field of Search ..... 42/89, 90, 1 R

[56] References Cited

U.S. PATENT DOCUMENTS

| | | | |
|---|---|---|---|
| 2,466,017 | 4/1949 | Farber | 42/90 |
| 3,710,497 | 1/1973 | Musgrave | 42/87 |
| 3,854,232 | 12/1974 | Musgrave | 42/87 |
| 4,291,483 | 9/1981 | Musgrave | 42/87 |
| 4,304,062 | 12/1981 | Pepe et al. | 42/87 |

FOREIGN PATENT DOCUMENTS

| | | | |
|---|---|---|---|
| 304379 | 2/1921 | Fed. Rep. of Germany | 42/87 |
| 555367 | 8/1943 | United Kingdom | 42/90 |

*Primary Examiner*—Charles T. Jordan

[57] ABSTRACT

A guide to facilitate insertion of cartridges into a magazine used in a firearm. The guide is positioned adjacent to the feed mouth of a magazine to control a cartridge as it is inserted therein. The guide includes a seat and a buttress against both of which the incoming cartridge slides as it is pushed into the magazine.

6 Claims, 11 Drawing Figures

MAGAZINE FILLING GUIDE

MAGAZINE FILLING GUIDE

Cartridge magazines for firearms have been developed to a high standard of efficiency. For military purposes there is a trend toward magazines with a large capacity. Some of these large capacity magazines employ a single ramming position, with two feed lips spaced apart a distance less than the diameter of a cartridge. With such an arrangement cartridges can only be inserted into the magazine singly. Because of the small size of the cartridges and the fact that they must be inserted against the resistance of the magazine spring, the filling process is inconvenient, particularly when the user is chilled, fatigued, or tense.

The principal object of this invention is to provide a guide which will facilitate filling a magazine with cartridges.

Another object is to provide such a guide which will be compact and light in weight.

Another object is to provide such a guide which will be economical to fabricate.

These and other objects of the present invention will be disclosed in the following specification taken in connection with the accompanying drawings, wherein.

Figures 1, 2, 3, 4, 5, 6, 7, 8, 9, 10, 11:
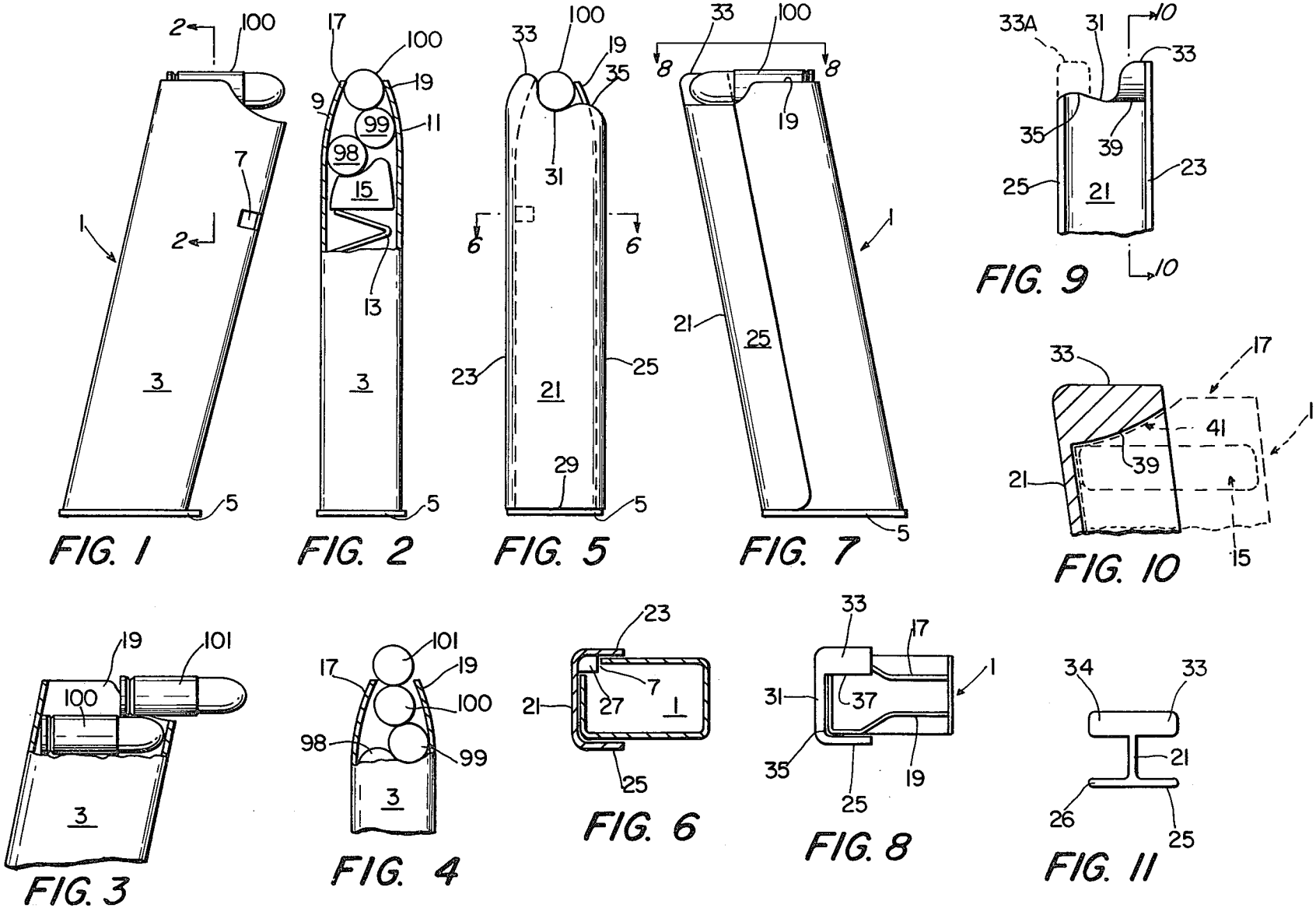
FIG. 1 is a side view of a typical magazine.
FIG. 2 is a front view, partly sectioned, of the magazine shown in FIG. 1.
FIG. 3 shows the upper portion of the magazine appearing in FIG. 1, but partly sectioned.
FIG. 4 is a front view of the portion appearing in FIG. 3, but partly sectioned.
FIG. 5 is a front view of a magazine filling guide, positioned on a magazine.
FIG. 6 is a horizontal section, taken in the plane indicated by arrows 6—6 on FIG. 5.
FIG. 7 is a side view of the guide and magazine shown in FIG. 5.
FIG. 8 is a top view of the guide and magazine shown in FIG. 7.
FIG. 9 is a rear view of a portion of a magazine filling guide.
FIG. 10 is a detail view showing how a guide can be fitted to some types of magazines.
FIG. 11 shows two magazine guides constructed as a unit, back-to-back.

The drawing have been prepared for the purpose of disclosing the invention, and they are merely exemplary. No particular magazine is shown, and the invention will be useful with a considerable variety of magazines. The discussion of magazines which employ a single ramming position is not intended as a limitation on the board utility of the invention. The guide disclosed herein can also be used with magazines which feed alternately from two different positions. The invention can be used with magazines for pistols, rifles, shotguns, machineguns, or any other type of firearm.

Referring to the drawings in detail, FIG. 1 shows a typical cartridge magazine 1, of a type well-known in the art. Magazine 1 includes a casing 3, a floor 5, and a notch 7 formed in the casing. The purpose of the notch is to provide an engagement surface for a latch (not shown) which is adapted for retaining the magazine in a feeding position in a firearm. A cartridge 100 is partly visible at the top of the magazine.

In FIG. 2 the same magazine is shown in a front view, partly cross-sectioned, as indicated by lines 2—2 on FIG. 1. The side walls of the casing are numbered 9 and 11, respectively. Within the casing a spring 13 is thrusting a cartridge follower 15 upward against a cartridge 98 which in turn forces cartridge 99 against cartridge 100, which rests against the inwardly turned end of walls 9 and 11. These ends are commonly known as the feed lips, and they are numbered 17 and 19 respectively. The portion of a magazine which includes the feed lips is frequently called the feed mouth.

It should be understood that the "front" of the magazines, or cartridges, in FIGS. 1 and 3, is at the right side of the drawings. In FIG. 7, the front of the magazine faces to the left.

Magazines of the type shown in FIGS. 1 and 2 are used extensively in pistols because they provide a large cartridge capacity. They are however, somewhat inconvenient to fill by hand, particularly if the users hands are chilled. This will be understood by reference to FIGS. 3 and 4 which show the method of filling normally employed.

The user holds a cartridge 101 in his fingers and pushes it downward against the front portion of cartridge 100. (He cannot push against the rear portion because the gap between lips 17 and 19 is less than the diameter of a cartridge.)

When cartridge 100 is sufficiently depressed, cartridge 101 can be moved under lips 17 and 19. The above procedure is repeated until the magazine is filled to capacity. However FIG. 3 is somewhat schematic as it shows an ideal relationship between the incoming cartridge and the top cartridge in the magazine. As can be understood by reference to FIG. 4, such an ideal condition does not occur in actual practice.

The cartridges are substantially cylindrical and they tend to roll over one another as the stack of cartridges within the magazine is depressed. By comparison of FIGS. 3 and 4 it will be understood that cartridge 100, while being depressed, is virtually uncontrolled at its rear, and is poorly controlled between cartridges 99 and 101 at its front. This poor control of the top cartridge, when depressed, is the principal cause of difficulty in filling a magazine of the type shown in FIGS. 1 and 2.

The present invention comprises a magazine filling guide which provides a substantial degree of control for the incoming cartridge while it depresses the said top cartridge. The incoming cartridge is kept substantially in alignment with the cartridge exit port formed by the front curved edges of feed lips 17 and 19. The location of the exit port can best be understood by reference to FIG. 3 wherein the rear of cartridge 101 is positioned partly within said port.

The result of the aforementioned control is that movement of the cartridge positioned just below the incoming cartridge, in any direction, can not cause the incoming cartridge to roll out of alignment with the exit port. Although commonly referred to as the "exit" port, the port is actually also used for insertion of cartridges into the magazine.

FIG. 5 shows a front view of a magazine filling guide comprising a base 21, shaped substantially as a channel with sides 23 and 25. As may be seen in FIG. 6 the channel is closely contoured to the front portion of a magazine. For simplicity of disclosure, only the casing of the magazine is shown in FIG. 6. In the corner of the channel is formed a lug 27, so positioned that it can enter notch 7 on the magazine casing to position the guide at a predetermined position relative to the magazine. Although the lower edge 29 of base 21 is shown touching the protruding edge of floor 5 of the magazine, this contact would not serve to position the guide in all instances. This is because magazines are frequently supplied in different lengths, to provide various cartridge capacities.

Near the top of the guide is formed a cartridge positioning seat 31 which is best seen in FIGS. 5 and 8. The central portion of the seat as shown in FIG. 5 is formed with a radius substantially similar to that of a cartridge, and at such a location on the guide as to be capable of aligning a cartridge with the exit port of a magazine.

On one side of the seat the guide is extended upward to form a buttress 33. On the other side of the seat the guide is cut down at 35 to provide clearance for the fingers of the user.

The exact configuration of the seat and the buttress may be varied to suit different magazines and different cartridges. FIG. 8 shows inner surface 37 of buttress 33 substantially in alignment with the top edge of lip 17 of a magazine. It will be readily understood by comparing FIGS. 5, 7, and 8 that a user can easily hold the guide and a magazine together, in engagement, gripped in one hand.

FIG. 9 shows the upper portion of the guide from the channel side. Broken line 33A indicates that a second buttress can be formed adjacent to seat 31, if desired. The shape of the front portion of the lips of each particular magazine will determine the configuration of the underside 39 of buttress 33. In FIG. 10 it is shown closely contoured to front portion 41 of lip 17 of magazine 1. This will expedite insertion of the first cartridge into the magazine, as will now be explained.

FIG. 10 shows the top portion of a magazine filling guide, engaged with the top portion of an empty magazine. It will be noted that follower 15 has moved upward under pressure from the magazine spring (not shown). If the guide was not in place on the magazine, the follower would move up even more until stopped by lips 17 and 19. The front portion of the follower would then be above the front portions of the lips, because the said front portions curve downward.

As may be understood by comparison of FIG. 8 and FIG. 10, when the guide is attached to an empty magazine, underside 39 of buttress 33 will depress the follower somewhat. This will expedite insertion of the first cartridge into the magazine.

To insert a cartridge, it is placed just in front of the exit port of the magazine and resting against the buttress, and the top most cartridge in the magazine. (In the case of the first cartridge, it will rest partly against the magazine follower.)

The cartridge is pressed downward, thus moving down the follower and any cartridges within the magazine. When the cartridge being inserted comes to rest against seat 31, it will be aligned with the exit port. It is then slid under the lips of the magazine. The above procedure is repeated until the magazine is filled to capacity.

It is not necessary that the base be formed as a channel. It can also be in the form of a hollow rectangle contoured to encompass a casing of a magazine. While this would provide a simple and secure method of engaging a guide with a magazine, it would also necessitate an increase in bulk, which is undesirable. As magazines for various firearms vary considerably in construction the exact shape of the base must be determined by the configuration of a given magazine.

FIG. 11 shows a top view of a magazine filling guide intended for use in either of two opposite orientations. To adapt the guide for this purpose, side 25 is extended to form side 26 and buttress 33 is extended to form buttress 34, thus, in effect, providing two guides, back-to-back. The purpose of this is to permit the use of one guide with either the right, or the left hand.

A magazine filling guide of the type disclosed herein ca be made of plastics, metal, or any other suitable material. Such a guide will be compact and easy to carry on the person of a user so as to be readily available when needed.

I claim:

1. A magazine filling guide of unitary construction comprising: a base adapted for engagement with a casing of a magazine in a predetermined fixed relationship therewith; and guide means fixed on said base, said guide means including seat means positionally adapted for aligning a cartridge with a front exit port on said casing.

2. A guide as set forth in claim 1 wherein said base is made substantially in a channel form.

3. A guide as set forth in claim 1 wherein said base is adapted to engage said casing in either of two different orientations.

4. A guide as set forth in claim 1 further provided with means capable of depressing a follower of an empty magazine when said guide is engaged with said magazine.

5. A guide as set forth in claim 1 wherein said base includes a lug positionally adapted to enter a notch on said casing when said base is engaged with said casing.

6. A guide as set forth in claim 1 wherein said seat means comprises an arcuate surface.

* * * * *